United States Patent [19]

Lautenschläger

[11] Patent Number: 4,506,409

[45] Date of Patent: Mar. 26, 1985

[54] SINGLE-PIVOT CABINET HINGE

[75] Inventor: Gerhard W. Lautenschläger, Brensbach, Fed. Rep. of Germany

[73] Assignee: Karl Lautenschlager KG, Mobelbeschlagfabrik, Reinheim, Fed. Rep. of Germany

[21] Appl. No.: 494,093

[22] Filed: May 12, 1983

[30] Foreign Application Priority Data

May 15, 1982 [DE] Fed. Rep. of Germany ..... 3218375

[51] Int. Cl.[3] ..... E05D 7/04; E05F 1/10

[52] U.S. Cl. ..... 16/238; 16/245; 16/249; 16/291; 16/347

[58] Field of Search ..... 16/238, 245, 246, 249, 16/291, 293, 305, 347

[56] References Cited

U.S. PATENT DOCUMENTS

| | | | |
|---|---|---|---|
| 4,134,180 | 1/1979 | Schneider et al. | 16/245 |
| 4,210,979 | 7/1980 | Boyd | 16/327 |
| 4,210,980 | 7/1980 | Lautenschlager, Jr. et al. | 16/246 |
| 4,265,000 | 5/1981 | Lautenschlager, Jr. | 16/238 |
| 4,290,167 | 9/1981 | Lautenschlager | 16/249 |
| 4,368,558 | 1/1983 | Grass | 16/332 |
| 4,397,064 | 8/1983 | Lautenschlager et al. | 16/380 |
| 4,422,214 | 12/1983 | Lautenschlager et al. | 16/291 |

FOREIGN PATENT DOCUMENTS

| | | | |
|---|---|---|---|
| 2330228 | 1/1975 | Fed. Rep. of Germany | 16/335 |
| 2005853 | 12/1969 | France | 16/335 |

*Primary Examiner*—Fred A. Silverberg

[57] ABSTRACT

A single-pivot cabinet hinge (10) for hanging doors has a cup (12) which can be fastened in a gain in the back of a door (16) and in which there is journaled one end of a pivot arm (24) whose other end bears a fastening plate (28) having a slot (30) engaged by a projection (60) of a mounting element (34) which can be fastened to the carcass of the cabinet. The fastening plate is displaceable on the mounting element (34) under the guidance of the projection and can be fixed at selectable positions by means of a fastening screw (50) which can be driven into the projection. The projection in turn is continuously adjustable in the mounting element (34) at right angles to the longitudinal axis of the slot and likewise fixable at selectable positions, so that the pivot arm together with the door cup is adjustable relative to the mounting element, and therefore a door hung by the hinge on a cabinet carcass is adjustable relative to the cabinet carcass, in coordinate directions at right angles to one another.

7 Claims, 13 Drawing Figures

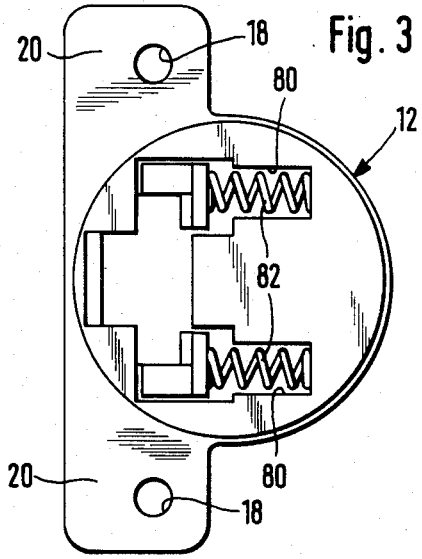
Fig. 3
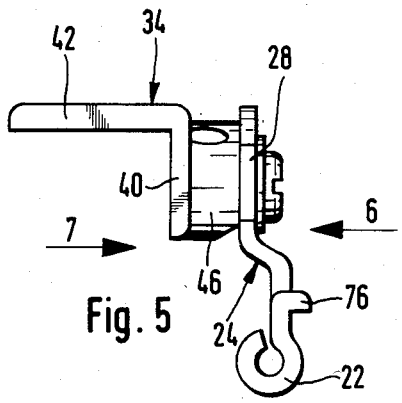
Fig. 5
Fig. 4
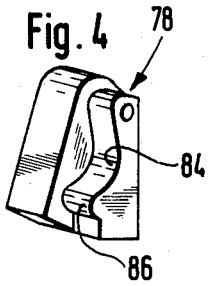
Fig. 6
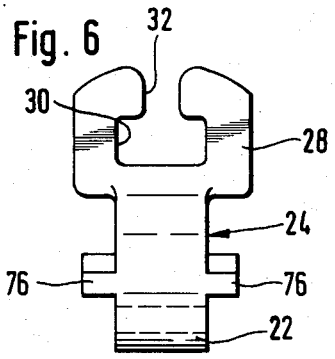
Fig. 7
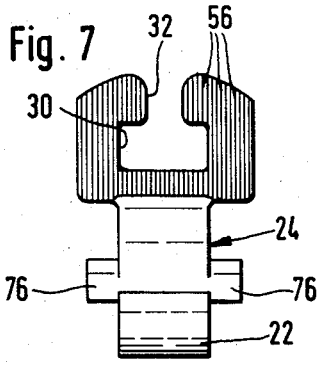

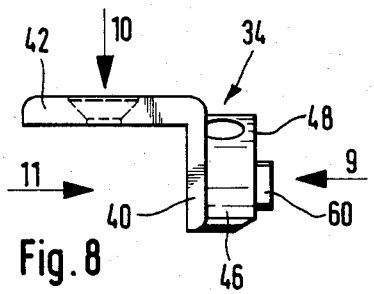
Fig. 8
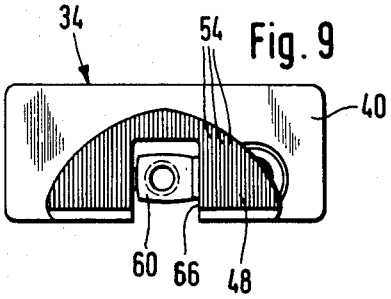
Fig. 9
Fig. 10
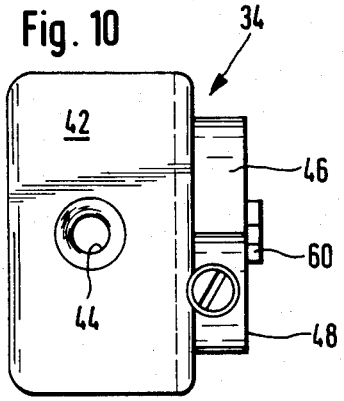
Fig. 11
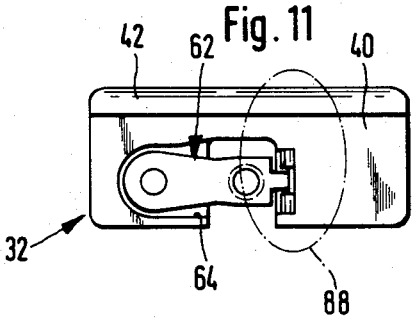
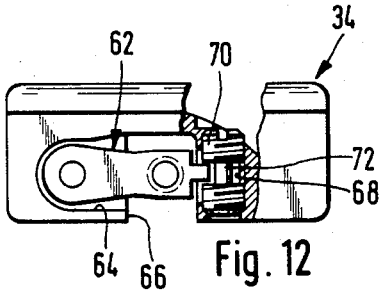
Fig. 12
Fig. 13
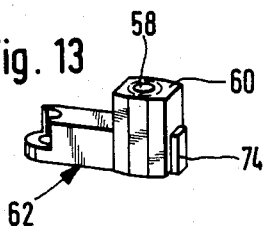

SINGLE-PIVOT CABINET HINGE

BACKGROUND OF THE INVENTION

The invention relates to a single-pivot cabinet hinge for a door leaf to be hung on the edge of a side wall of a cabinet carcass, or for one to be hung on a frame projecting inwardly at right angles from the cabinet side walls and reducing the size of the opening provided for the door, such cabinet hinge having a door-related hinge part in the form of a cup which can be set in a gain in the back of the door leaf and in which the door-leaf end of a pivot arm is journaled while the other end, which lies within the cup when the hinge is in the closed position, is fastened releasably on a mounting element which can be fastened to the cabinet side wall or to the frame, as the case may be, such as to be adjustable in coordinate directions at right angles to one another.

Whenever door leaves are to be hung on a cabinet carcass on hinges which are to be invisible when the door is closed, multiple-pivot hinges are used as a rule, such as for example four-pivot hinges or crosslink hinges, because when the door is opened they superimpose on the swinging movement a component of movement which lifts the door leaf away from the carcass, since without such movement it would be unable to open, Single-pivot hinges, i.e., hinges with a fixed pivots axis, however, used to be hung adjacent ot the front face of the door and in front of the edge of the cabinet side wall, but then, when the door is closed, the tubular parts of the pivot enveloping the fixed pivot pin of such single-pivot hinges are visible when the door is closed. Since multiple-pivot hinges are expensive owing to their complex construction, attempts have recently been made to develop single-pivot hinges of the kind mentioned above, which are invisible when the door is closed since the hinge pivot axis is situated within a door-related hinge part in the form of a cup set in a gain in the back of the door. Inasmuch as the door cup of these single-pivot hinges has to accommodate most of the hinge parts when the door is in the closed state, the problem arises of providing within the cup, i.e., within a very limited amount of space, for the necessary adjustment of the door overlap or clearance and for the upward and downward adjustment of the door, and this problem is aggravated when the hinge additionally is to have a self-closing or over-center mechanism which resiliently holds the door in the closed position.

The invention is addressed to the problem of creating a single-pivot hinge which will be invisible when the door is in the closed position, and which will permit a quick and reliable upward or downward adjustment of the door, and at the same time accommodate an over-center mechanism without thereby impairing its adjustability.

SUMMARY OF THE INVENTION

Setting out from a single-pivot hinge of the kind mentioned above, this problem is solved in accordance with the invention by the fact that the pivot arm is in the the form of a planar fastening plate at one end, which can be fastened by means of a screw against the associated planar face of a mounting platform which, when the hinge is in the closed state, lies within the door cup, and a slot running parallel to the hinge pivot axis is provided in the planar fastening plate. This slot is engaged by a bored and tapped projection protruding from the face of the mounting platform, and the fastening screw is driven into the bore in the projection. This projection is part of an adjusting element which is adjustable in the mounting platform approximately at right angles to the hinge pivot axis, and can be fixed at any desired position within the adjustment range. Within the range provided by the length of the slot, the fastening plate is thus displaceable upward and downward on the mounting platform, i.e., a door hung by the hinge can be adjusted upwardly and downwardly, while the amount of door overlap is adjusted relative to the mounting element by the displacement of the projection engaged in the slot. In order to be able to tighten the fastening plate of the pivot arm directly against the face of the mounting platform with a screw, with the interposition of a washer under the screw head if desired, it is desirable to have the projection extend beyond the face of the mounting platform by an amount that is smaller than the thickness of the fastening plate of the pivot arm.

The removal and subsequent reattachment of a door hung by single-pivot hinges of the invention on a cabinet carcass can be performed by loosening the fastening screw, thus separating the fastening plate from the mounting platform. But this can be accomplished still more easily by providing an entry slot running from the edge of the fastening plate into the slot provided in the latter as described above, the width of this entry slot being smaller than the width of the projection engaging the adjustment slot, but larger than the diameter of the shank of the fastening screw. The fastening screw then need only be loosened by slightly more than the length to which the projection extends above the mounting platform to enable the shank of the fastening screw to pass through the entry slot, thus permitting the fastening plate to be removed from or placed onto the mounting platform. On the other hand, if the fastening screw is loosened by less than the height to which the projection extends above the platform, the fastening plate can be adjusted along the length of the adjusting slot without the danger of unintentional separation of the pivot arm from the mounting platform, because the entry slot is narrower than the projection, thus preventing the latter from passing through the entry slot.

The adjusting element, in an advantageous further development of the invention, is in the form of a rocking lever journaled in a recess in the base or bottom of the mounting platform and having on its free end the projection which engages the slot in the fastening plate. This rocking lever lies in a section of the recess which opens into the face of the mounting platform.

To vary the position of the rocking lever, i.e., to change the amount of overlap of a door, the mounting platform contains a tapped through-bore adjacent the free end of the lever, running parallel to the platform face and at right angles to the hinge pivot axis, and having in its middle portion an opening into the recess. A threaded spindle having an annular groove free of threads in its middle portion is threaded into the tapped through-bore, its annular groove being engaged by a cleat-like projection on the free end of the rocking lever. By turning the spindle with a screwdriver while the fastening screw is only slightly loosened, the position of the rocking lever and thus the position of the projection can be continuously varied relative to the mounting platform. The self-locking of the engaged threads prevents accidental loss of the adjustment.

Accidental loss of a correct vertical adjustment of the hinge, once achieved, can be prevented, even when the fastening screw is slightly loose, by providing in the confronting surfaces of the mounting platform and of the fastening plate of the pivot arm a pattern of parallel, closely spaced serrations running at right angles to the pivot axis of the hinge.

The arrangement of an over-center mechanism in the single-pivot hinge of the invention is possible, in further development of the invention, by providing the portion of the pivot arm adjoining the end journaled in the door cup with two catch projections protruding in parallel spaced relationship from its opposite edges. With each of these projections there is associated a tongue which can pivot in the door cup about an axis parallel to the hinge pivot axis, the tongues being biased by compression springs into the paths of the catch projections such that, as the hinge approaches the closed position, the projections run onto a cam surface on the tongue, forcing the latter back against the action of the compression spring, until shortly before the hinge reaches the closed position they pass over onto a catch surface adjoining the cam surface on the tongues, such that the latter exert on the projections a thrust acting in the closing direction.

The tongues are best journaled on opposite sides of the door cup, close to the rim of the cup, with their free ends pointing toward the floor of the cup, while in the bottom of the cup, in a socket in the cup floor, there is disposed for each tongue an elongated, compressively biased helical spring whose one end engages the free end of its associated tongue, while its other end is supported in the socket.

The invention is explained in the following description of an embodiment, in conjunction with the drawing.

BRIEF DESCRIPTION OF THE DRAWING

FIG. 3 is a view of the bottom of the door cup, seen in the direction of the arrow 3 in FIG. 2, FIG. 4 is a perspective view of one of the two tongues forming part of an over-center mechanism and disposed in the door cup, FIG. 5 is a top view of the mounting platform and of the pivot arm fastened thereon, seen in the direction of the arrow 5 of FIG. 1, FIG. 6 is a view of the pivot arm of the hinge as seen in the direction of the arrow 6 in FIG. 5, FIG. 7 is a rear view of the pivot arm, seen in the direction of the arrow 7 of FIG. 5, FIG. 8 is a view of the mounting element of the hinge of the invention, seen in the same direction as in FIG. 5, FIG. 9 is a view of the mounting element seen in the direction of arrow 10 in FIG. 8, FIG. 10 is a view of the mounting element, seen in the direction of arrow 10 in FIG. 8, FIG. 11 is a view of the mounting element, seen in the direction of the arrow 11 in FIG. 8, FIG. 12 is a view corresponding to FIG. 11, containing a cut-away view of the portion indicated in broken lines at 88 in the latter, and FIG. 13 is a perspective view of a rocking lever which is disposed pivotally in the mounting element.

Figure 1:
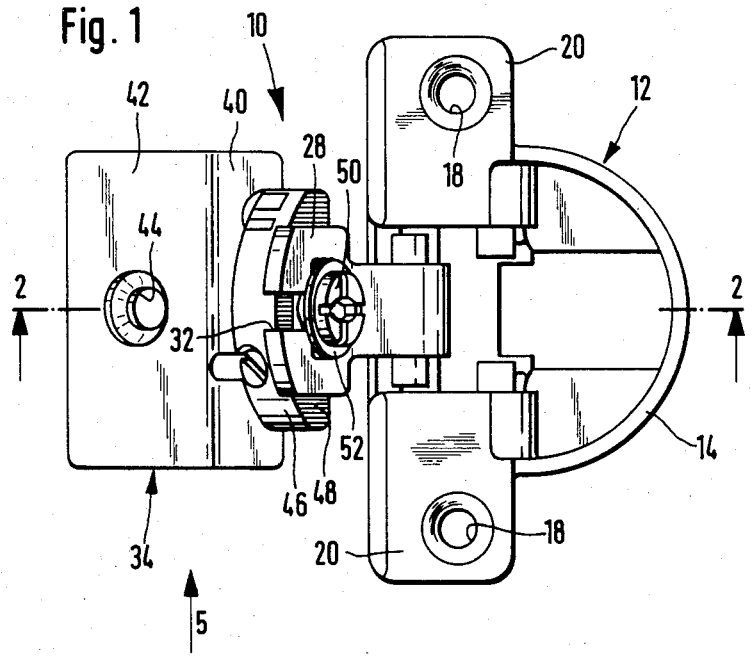
FIG. 1 is a perspective elevational view of a single-pivot hinge constructed in the manner of the invention, in the fully opened state.
Figure 2:
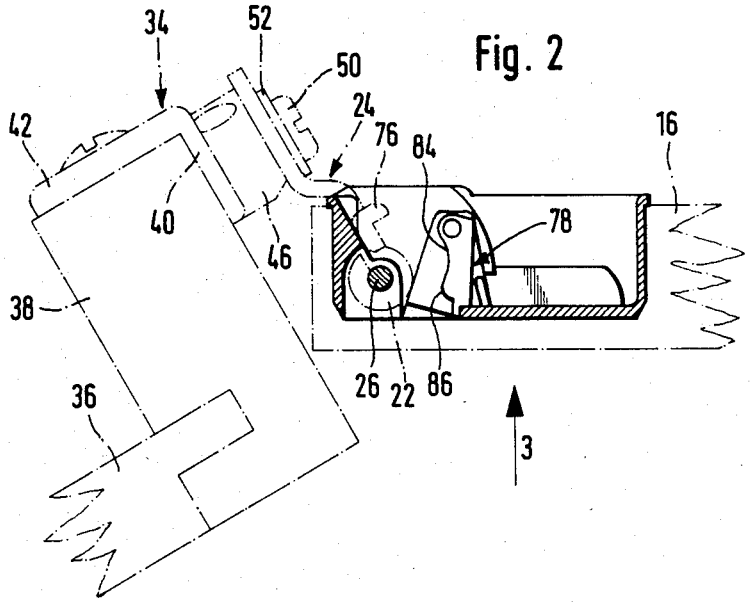
FIG. 2 is a cross-sectional view through the door-related hinge part in the form of a cup for installation in a gain on the back of the door, as seen in the direction of the arrows 2—2 of FIG. 1, the pivot arm and the hinge mounting element as well as the adjacent portion of the cabinet carcass and door being indicated in broken lines.

The single-pivot hinge shown in FIGS. 1 and 2 and designated generally by the number 10 has a door-related hinge part in the form of a cup, whose portion 14 can be fastened in a gain provided in the back of a door 16 (FIG. 2), thin wings 20 provided each with a countersunk bore 18 for a mounting screw extending for this purpose from the rim of the cup 14 on opposite sides thereof so as to lie on the surface of the back of the door. In the interior of the cup 14, in the area situated on the left in FIGS. 1 and 2, the pivot eye 22 formed by rolling the end of a cranked pivot arm 24 (see also FIGS. 5, 6 and 7) is journaled on a pin 26 held in the wall of the cup, the length of the pivot arm being such that, upon a rotation clockwise from the open position represented in FIGS. 1 and 2, it will come to be situated entirely within the cup 14 when the hinge is in the closed state. The other end of the pivot arm 24 is made in the form of an enlarged, planar fastening plate 28 in which an adjusting slot 30 disposed parallel to the hinge axis is provided, while an entry slot 32 runs from the adjusting slot to the end of the pivot arm remote from the pivot eye.

The fastening plate 28 is attached to a mounting element 34 which is turn serves for the fastening of the hinge 10 to the cabinet carcass. FIG. 2 shows how the mounting element is fastened to a frame element 38 which projects inwardly from the cabinet side wall 36 and reduces the size of the opening provided in the cabinet for the door. The mounting element 34 has for this purpose a bracket of L-shaped cross section 40–42 adapted to be fitted to an arris of the frame element 38 and to be held in place by a screw driven into the latter through a bore 44. The piston 42 of the bracket can be omitted if desired. The mounting element is then screwed only to the front side of the frame element 38, so that in that case countersunk screw holes must be provided in the remaining portion 40 of the bracket.

A mounting platform 46 rises from the bracket portion 40 and is of such size and shape that it can be contained, together with the mounting plate 28, within the cup 14. The fastening plate 28 can be clamped to the planar face 48 of the platform by the head 50 of the fastening screw, with the interposition, if desired, of a washer 52. The face 48 and the confronting bottom of the fastening plate 28 are both provided with a pattern 54 and 56 of parallel, closely spaced serrations. The serrated patterns 54 and 56, when pressed against one another, constitute a virtually interlocked connection between the fastening plate 28 and the mounting platform 46 of the mounting element 34, as long as the fastening screw is tightened. The threaded shank of the fastening screw holding the fastening plate 28 on the mounting platform 46 is not driven directly into the mounting platform 46 itself, but into a tap 58 in a projection 60 engaging the adjusting slot 30 in the fastening plate 28, the projection being part of an adjusting lever 62 whose position can be changed relative to the mounting platform 46. The adjusting lever 62 is in the form of a rocking lever journaled in the bottom of the platform 46, i.e., the opposite side from the face 48. The projection 60 is on the free end of the rocking lever 62 and extends through a portion 66 of the recess 64 at which the latter opens into the face 48. When the adjusting lever 62 pivots, the projection extending from the recess portion 66 shifts approximately parallel to the serrations 54 in the face 48. Since the projection 60 is substantially fitted to the adjusting slot 30 in the fastening plate 28, the fastening plate will then be displaced together with the projection 60 across the face 48 parallel with the serrations 54. It is clear that the fastening screw clamping the fastening plate 28 onto the face 48 must be slightly loosened for this purpose. On the other hand, it is also clear that an adjustment of the fastening plate in the direction of the adjusting slot 30 is also possible if the fastening screw is loosened to such an extent that the pattern 54 and 56 of the serrations in the face 48 and in fastening plate 28, respectively, can slide one over the other. The special design of the adjusting lever 62 and its accommodation is the mounting element 34 can be seen in detail in FIG. 13 and in FIGS. 8 to 12, respectively.

As seen in FIGS. 10 and 12, the mounting platform 46 has a threaded bore 68 disposed parallel to the face 48 and to the serrations 54. In its middle portion the bore 68 is open to the recess 66. Into this bore 68 there is threaded a spindle 70 which has in a middle portion adjacent the projection 60 of the adjusting arm 62 an annular groove 72 containing no threads. This annular groove is engaged by a cleat 74 on the free end of the adjusting lever 62. When the spindle 70 is turned by its slotted end exposed in the tapped bore 68, it is displaced accordingly in the latter, thereby carrying with it the cleat 74 engaged in the annular groove 72, resulting in a pivoting of the adjusting lever 62 and thus in a displacement of projection 60 in the recess opening 66. The spindle 70 therefore permits a continuous and self-locking variation of the position of projection 60 in the mounting platform 46.

The arm 24 journaled at one end in the cup 12 and adjustably fastened on the mounting element 34 at the other end, in the manner described, has, as seen in FIGS. 6 and 7, in the area adjoining the pivot eye 22, two catch projections 76, each of which is associated with a tongue 78 pivotally mounted inside of the cup 14 (FIG. 2). The tongues 78, which are pivoted at their upper end adjacent the rim of the cup 14 on opposite side walls thereof, are biased at their lower end adjacent the bottom of the cup by compressed coil springs 82 seeking to turn them clockwise to a starting position in which they are held by an associated step in the cup. When the arm 24 swings from the open position to the closed position, the catch projections first run against a cam surface 84 of the tongue and slide on this cam surface causing the tongue to swing increasingly against the action of the associated coil springs 82. Shortly before reaching the closed position, the catch projections 76 then pass over onto the catch surface 86 adjoining the cam surface 84, and this catch surface under the pressure of the associated coil springs snaps over the catch projections and thus exercises a thrust on the arm 24 which acts in the closing direction. 9n

I claim:

1. A single-pivot cabinet hinge for a door leaf to be hung on a cabinet, said cabinet hinge being adapted to be moved from an open to a closed position and vice versa and having a pivot axis, and also having a door-related part in the form of a cup adapted to be set in a gain in the back of a door leaf, and a cabinet-related part with a mounting element adapted to be fastened on a cabinet, said hinge having a pivot arm with a first door-leaf end pivotally mounted in said cup and a second, cabinet end fastened releasably on said mounting element so as to be adjustable in coordinate directions at right angles to one another, said mounting element having a mounting platform with a planar face, said second end being in the form of a planar fastening plate having a certain thickness, a fastening screw with a threaded shank of a certain diameter, for placing said plate into engagement with said planar face of said mounting platform, said mounting platform lying in the cup when the hinge is in the closed position, said fastening plate having a first slot disposed parallel to the hinge pivot axis, a projection having a certain width and engaging into said slot and protruding from the planar face of said mounting platform and having a tap, said tap receiving the threaded shank of said screw, said projection being part of an adjusting element which is adjustable within a certain range, approximately at right angles to the hinge pivot axis, in said mounting platform and adapted to be locked at selected positions within said range, said adjusting element being a rocking lever journaled in a side of the mounting element facing the cabinet when attached thereto a free end of said rocking lever having said projection which is situated in a section of a recess opening onto said planar face of said mounting platform and which engages said first slot in said planar fastening plate.

2. A single-pivot cabinet hinge according to claim 1, wherein said projection protrudes from said planar face of said mounting platform by a length that is slightly less than the thickness of said fastening plate.

3. A single-pivot cabinet hinge according to claim 1, wherein said fastening plate has a second slot which runs from an edge thereof to said first slot, said second slot being of a width smaller than the width of said projection engaging said first slot, but greater than the diameter of the threaded shank of the fastening screw.

4. A single-pivot cabinet hinge according to claim 1, wherein said mounting platform is pierced through adjacent the free end of said rocking lever by a threaded bore running parallel to said planar face and at right angles to the hinge pivot axis, said bore being open in its middle area below said planar face to said recess, a threaded spindle screwed into the threaded bore and having an annular groove free of threads in said open middle area, and a cleat-like projection on the free end of said rocking lever and engaging the annular groove.

5. A single-pivot cabinet hinge according to any one of claims 1, 2, 3 or 4, wherein a pattern of parallel, closely succeeding serrations disposed at right angles to the hinge pivot axis is provided in the surface of said fastening plate facing said planar face and in said planar face.

6. A single-pivot cabinet hinge according to claims 1, 2, 3 or 4, wherein said pivot arm has in its area adjoining said first end two catch projections protruding in parallel spaced relationship from its opposite sides, two tongues respectively associated with said projections and being pivotable about an axis parallel to the hinge pivot axis, each tongue having a first cam surface, a pair of compression springs respectively bringing said tongues into paths of movement of said catch projections such that, as the hinge-closed position is approached, the catch projections run onto said first cam surfaces and rock said tongues against the action of said compression springs until, shortly before reaching the hinge-closed position, said catch projections pass over onto second, catch surfaces adjoining said first, cam surfaces, said catch surfaces being so configured that they exert on the catch projections a thrust acting in a direction towards the closed position of the hinge.

7. A single-pivot cabinet hinge according to claim 6, wherein said cup has an open top and a bottom, and wherein said tongues are journalled adjacent the open top on opposite side walls of said cup, and point with free ends in the direction of the cup bottom, for each tongue an elongated coil spring under compressive bias being disposed in a socket in the cup bottom at right angles to the hinge pivot axis and parallel to the cup bottom, each spring having an end engaging the bottom, free end of the associated tongue.

* * * * *